US011085164B2

(12) United States Patent
Schiffbauer et al.

(10) Patent No.: US 11,085,164 B2
(45) Date of Patent: Aug. 10, 2021

(54) COMBINATION FREEZING HEAD FOR NITROGEN-BRINE FREEZING

(71) Applicant: Linde Aktiengesellschaft, Munich (DE)

(72) Inventors: Reiner Schiffbauer, Ennetburgen (CH); Abraham Sliwo, Walchwil (CH)

(73) Assignee: Linde Aktiengesellschaft, Munich (DE)

( * ) Notice: Subject to any disclaimer, the term of this patent is extended or adjusted under 35 U.S.C. 154(b) by 167 days.

(21) Appl. No.: 16/344,938

(22) PCT Filed: Oct. 18, 2017

(86) PCT No.: PCT/EP2017/025308

§ 371 (c)(1),
(2) Date: Apr. 25, 2019

(87) PCT Pub. No.: WO2018/077478

PCT Pub. Date: May 3, 2018

(65) Prior Publication Data

US 2019/0264415 A1 Aug. 29, 2019

(30) Foreign Application Priority Data

Oct. 27, 2016 (DE) ..... 102016012843.7
Mar. 2, 2017 (EP) ..... 17020084

(51) Int. Cl.
*E02D 3/115* (2006.01)
*E02D 19/14* (2006.01)

(52) U.S. Cl.
CPC ..... *E02D 19/14* (2013.01); *E02D 3/115* (2013.01)

(58) Field of Classification Search
CPC ..... E02D 3/115; E02D 19/14
(Continued)

(56) References Cited

U.S. PATENT DOCUMENTS 3,220,470 A * 11/1965 Balch ..... E21D 1/14 165/300
3,720,065 A 3/1973 Sherard
(Continued)

FOREIGN PATENT DOCUMENTS

DE 102013018210 A1 4/2015

OTHER PUBLICATIONS

International Search Report dated Dec. 12, 2017 issued in corresponding PCT/EP2017/025308 application (2 pages).
(Continued)

*Primary Examiner* — Sunil Singh
(74) *Attorney, Agent, or Firm* — Millen White Zelano & Branigan, PC; Brion P. Heaney

(57) ABSTRACT

An apparatus for freezing ground comprises a freezing head extending along a longitudinal axis, and a first conduit for introducing a first cooling medium or a second cooling medium different therefrom into an interior of the freezing head. The first conduit opens into the interior a second conduit introduces the second cooling medium into the interior of the freezing head or draws the first and/or the second cooling medium off from the interior of the freezing head. The second conduit opens into the interior of the freezing head, the apparatus has at least three separate connections, namely a first connection, via which the first cooling medium can be introduced into the interior of the freezing head, a second connection, via which the second cooling medium can be introduced into the interior of the freezing head, and a third connection, via which the first or the second cooling means can be drawn off from the interior of the freezing head.

18 Claims, 11 Drawing Sheets

(58) Field of Classification Search
USPC ..... 405/130; 165/45; 62/260
See application file for complete search history.

(56) References Cited

U.S. PATENT DOCUMENTS

| | | | | |
|---|---|---|---|---|
| 9,708,787 | B2 | 7/2017 | Heninger et al. | |
| 2007/0266715 | A1* | 11/2007 | Sopko ..... | E21B 36/001 62/66 |
| 2016/0265181 | A1 | 9/2016 | Heninger et al. | |

OTHER PUBLICATIONS

Search Report dated Jul. 8, 2019 issued in corresponding EP17020084.4 application (5 pages).

* cited by examiner

COMBINATION FREEZING HEAD FOR NITROGEN-BRINE FREEZING

The invention pertains to a ground freezing apparatus.

The freezing method is frequently used for solidifying or sealing ground, particularly foundation soil. Liquid nitrogen or liquefied air is used as coolant in known methods used for this purpose. It is likewise known to carry out the freezing process with a brine, which in turn is tempered by means of a refrigeration system.

Due to the low temperature of liquid nitrogen, ground freezing with nitrogen takes place much faster than with a brine, but the operating costs (energy costs) for liquid nitrogen over prolonged freezing periods are significantly higher than for brine.

In light of the requirements regarding the freezing time, which should be as short as possible, and the (longer and longer) preservation of the frozen state of the treated ground, ground freezing processes, in which an ice body is initially produced with liquid nitrogen and subsequently preserved with brine cooling, have been carried out on various occasions.

Based on these circumstances, the present invention aims to make available a ground freezing apparatus that makes it possible to easily produce and preserve an ice body with different coolants.

This objective is attained by means of an ground freezing apparatus comprising:

- a freezing head extending along a longitudinal axis,
- a first conduit for introducing a first cooling medium or a second, different cooling medium into an interior of the freezing head, wherein the first conduit opens into the interior, and
- a second conduit for introducing the second cooling medium into the interior of the freezing head or for withdrawing the first or the second cooling medium from the interior of the freezing head, wherein the second conduit opens into the interior of the freezing head,
- wherein the apparatus has at least three separate connections, namely a first connection, via which the first cooling medium can be introduced into the interior of the freezing head, a second connection, via which the second cooling medium can be introduced into the interior of the freezing head, and a third connection, via which the first or the second coolant can be withdrawn from the interior of the freezing head.

In this way, the inventive apparatus or the inventive freezing head respectively makes it possible to use two different coolants, for example a first coolant, particularly in the form of liquid nitrogen, and a second coolant, particularly in the form of a brine, wherein the design of the apparatus eliminates the need to prepare and install completely different connections for switching from nitrogen to brine. According to the invention, switching between the two coolants requires no more than a changeover of a corresponding conduit on the third connection such that the nitrogen waste gas can initially be withdrawn via the third connection and subsequently the heated brine. The brine particularly has to be pressed out of the freezing head via one of the conduits in order to switch from brine to nitrogen.

The invention therefore eliminates an increased installation effort and correspondingly high costs in the production of an ice body with two different coolants. It is furthermore possible, in particular, to selectively support brine freezing with nitrogen cooling in a comparatively simple manner.

The two conduits arranged in the freezing head preferably are realized in the form of standpipes extending along the longitudinal axis, wherein the longitudinal axis extends, e.g., along the vertical line when the freezing head is in its intended or operational position (different orientations are also possible depending on the spatial position of a recess, in which the freezing head is arranged). The axial direction of the freezing head or the conduits therefore refers to the direction along the longitudinal axis whereas the radial direction of the conduits or the freezing head refers to a (radial) direction extending perpendicular to the longitudinal axis.

According to a preferred embodiment of the inventive apparatus, it is proposed that the first connection is formed on the first conduit such that the first coolant (e.g. liquid nitrogen or another suitable liquid gas) can be introduced into the first conduit via the first connection and from the first conduit into the interior of the freezing head, wherein the first connection particularly is provided on the face of the first conduit such that the first coolant can be introduced into the first conduit, as well as into the interior of the freezing head, in the axial direction of the first conduit.

According to a preferred embodiment of the inventive apparatus, it is furthermore proposed that the second connection is formed on the first conduit outside the freezing head, wherein the second coolant (e.g. a brine) can be introduced into the first conduit via the second connection and from the first conduit into the interior of the freezing head. Furthermore, the third connection may additionally or alternatively be formed on the second conduit outside the freezing head, wherein the first coolant (e.g. nitrogen), particularly in the form of a gaseous phase (e.g. nitrogen waste gas), or the second coolant (e.g. brine) can be withdrawn from the second conduit, as well as from the interior of the freezing head, via the third connection.

In this example, the first conduit therefore serves for introducing the first coolant (e.g. liquid nitrogen or liquid air) or the second coolant (e.g. a brine in the form of a $CaCl_2$ solution), wherein an ice body is built up, e.g., by means of the first coolant and subsequently preserved by means of the second coolant. The second conduit and the third connection then serve for respectively withdrawing the first coolant (particularly in its gaseous phase when a liquid gas is used as first coolant) and the second coolant. The switch from the first coolant to the second coolant requires no changeover on the forward side. On the return side, the switch can be easily realized by changing over the connections. The brine preferably is pressed out of the freezing head via the second conduit prior to the switch from the second coolant (e.g. brine) to the first coolant (e.g. liquid gas such as liquid nitrogen).

According to another embodiment of the inventive apparatus, it is proposed that the apparatus has at least four connections, wherein the second coolant can be withdrawn from the interior of the freezing head via said fourth connection, and wherein the first coolant particularly can be withdrawn from the interior of the freezing head via the third connection.

According to an embodiment of the inventive apparatus, it is furthermore proposed that the fourth connection is formed on the face of the second conduit such that the second coolant (e.g. brine) can be withdrawn from the second conduit in the axial direction thereof (i.e. in the direction of the longitudinal axis), wherein the third connection particularly is formed laterally on the second conduit such that the first coolant (e.g. nitrogen) can be withdrawn from the second conduit, particularly in the form of a gaseous phase, in the radial direction of the second conduit, and wherein the second connection particularly is formed laterally on the first conduit such that the second coolant can be introduced into the first conduit, as well as into the interior of the freezing head, in the radial direction of the first conduit.

According to a preferred embodiment of the inventive apparatus, it is furthermore proposed that the third and the fourth connection are respectively provided on a shell of the freezing head, wherein the third and the fourth connection particularly are fluidically connected to a common connecting piece, which preferably extends from the shell of the freezing head in the radial direction, and wherein the two coolants can be withdrawn from the interior of the freezing head in the radial direction of the freezing head via said connecting piece. In this case, said connecting piece with the third and fourth connection provided thereon particularly is realized in a T-shaped manner.

According to a preferred embodiment of the inventive apparatus, it is furthermore proposed that the third and the fourth connection are respectively provided separately on a shell of the freezing head, wherein the third and the fourth connection are respectively formed on an associated connecting piece, wherein the two connecting pieces originate from the shell of the freezing head, and wherein the two connecting pieces preferably extend from the shell in a radial direction, preferably in opposite directions (the third and the fourth connection and the respectively associated connecting piece particularly are arranged on opposite sides of the freezing head) such that the respective coolant can be respectively withdrawn from the interior of the freezing head via the respective connecting piece in the radial direction of the freezing head.

According to a preferred embodiment of the inventive apparatus, it is furthermore proposed that the apparatus has at least five connections, wherein the interior of the freezing head can be ventilated via the fifth connection, e.g. prior to a switch from the first coolant (e.g. liquid gas such as nitrogen) to the second coolant (e.g. brine) and/or the second coolant can be pressed out of the interior of the freezing head via said fifth connection (e.g. when switching from the second coolant (e.g. brine) to the first coolant (e.g. liquid gas)).

According to a preferred embodiment of the inventive apparatus, it is furthermore proposed that said fifth connection is formed laterally on said connecting piece, on which the fourth connection is also formed (see above).

According to an embodiment, the fifth connection may furthermore also be provided separately on the shell of the freezing head, wherein the fifth connection particularly is formed on an associated connecting piece that extends from the shell of the freezing head, preferably in the radial direction of the shell.

According to a preferred embodiment of the inventive apparatus, it is furthermore proposed that the apparatus has at least six connections, wherein a gaseous medium can be introduced into the interior of the freezing head via the sixth connection such that the second coolant particularly can be pressed out of the interior of the freezing head by means of the gaseous medium, e.g. when switching from the second coolant (e.g. brine) to the first cooling (e.g. liquid nitrogen).

According to an embodiment, the sixth connection may be provided separately on the shell of the freezing head, wherein the sixth connection particularly is formed on an associated or separate connecting piece that preferably extends from the shell of the freezing head in the radial direction.

According to an alternative embodiment, the sixth connection may furthermore also be formed laterally on said connecting piece, on which the third connection is also formed (see above).

According to a preferred embodiment of the inventive apparatus, it is furthermore proposed that the first and/or the second conduit respectively enter the freezing head in the axial direction (i.e. in the direction of the longitudinal axis of the freezing head or in the direction of the respective longitudinal axis of the corresponding conduit, respectively).

According to a preferred embodiment of the inventive apparatus, it is furthermore proposed that the freezing head is closed toward the bottom by a base connected to the shell and toward the top by a cover connected to the shell, wherein the first and/or the second conduit particularly extend into the interior of the freezing head through said cover.

According to an embodiment of the inventive apparatus, the first second conduit furthermore may protrude deeper into the interior of the freezing head than the second conduit along the longitudinal axis of the freezing head. Alternatively, the second conduit may protrude deeper into the interior of the freezing head than the first conduit. If applicable, both conduits may also protrude into the interior by the same depth.

If applicable, the first and/or the second conduit furthermore may be respectively arranged in the interior of the freezing head so as to be axially displaceable along the longitudinal axis by means of a gland packing.

According to an embodiment of the invention, it is furthermore proposed that at least one of the connections (and the associated conduit/connecting piece), preferably multiple connections (and the respectively associated conduit and connecting piece), preferably all connections (and the respectively associated conduit and connecting piece), can be respectively shut off by means of a valve of the apparatus, particularly a respective remote-controlled valve.

According to a preferred embodiment of the invention, it is furthermore proposed that the respective connection for withdrawing the first coolant and the respective connection for withdrawing the second coolant from the interior of the freezing head are spatially arranged in the same plane or on different planes (with said planes particularly extending perpendicular to the longitudinal axis of the freezing head).

According to a preferred embodiment of the invention, it is furthermore proposed that the apparatus has at least one or more temperature sensors, which respectively are rigidly connected to the freezing head. The temperature sensors may serve, for example, for controlling the supply of the first or second coolant. In this case, the temperature measurement may take place directly in the medium. For example, a T-element may be integrated or a sleeve may be welded/soldered in such that the temperature sensor can be directly installed in the coolant flow.

According to an embodiment of the invention, it is furthermore proposed that the first coolant is nitrogen and/or that the second coolant is a brine. Other liquid gases such as helium may also be used instead of nitrogen.

According to a preferred embodiment of the invention, it is furthermore proposed that the conduits for introducing the first coolant and the second coolant enter the freezing head in the axial direction.

According to a preferred embodiment of the invention, it is furthermore proposed that the connecting pieces for withdrawing the first and the second coolant exit the freezing head in the radial direction.

The joints of the inventive apparatus, particularly between the connections and the connecting pieces, conduits or the shell, may be welded, soldered, screwed or produced otherwise. The individual components, particularly the first and the second conduit, the connecting pieces and the shell of the freezing head, may have varying diameters and lengths. The connections particularly may be realized integrally with the freezing head, the conduits or the connecting pieces (e.g. milled and/or turned from one whole piece).

Another aspect of the present invention concerns a ground freezing method, wherein the inventive method particularly utilizes an inventive apparatus and comprises at least the steps of:

arranging a freezing head of a ground freezing apparatus in the region of an ice body to be produced, wherein said ice body is formed by frozen ground, introducing a first coolant into an interior of the freezing head in order to produce the ice body, wherein the first coolant particularly comprises a liquid gas (e.g. nitrogen, helium or another suitable liquid gas), and introducing a second coolant (e.g. a brine) into the interior of the freezing head in order to preserve the frozen state of the ice body, wherein the first coolant is introduced into the interior of the freezing head via an associated first connection, and wherein the second coolant is introduced into the interior of the freezing head via a second connection, which is formed separately of the first connection.

It is also conceivable to initially cool with the second coolant and subsequently with the first coolant. Furthermore, the two coolants may also alternate several times.

According to an embodiment of the method, the first coolant preferably is withdrawn from the freezing head via a separate third connection.

According to an embodiment of the method, it is furthermore preferred to withdraw the second coolant from the freezing head via a separate fourth the connection.

According to an embodiment, it is furthermore preferred to ventilate the freezing head via a separate fifth connection, particularly prior to a switch from the first coolant to the second coolant. In addition, the second coolant can be pressed out of the interior of the freezing head via the fifth connection (e.g. when switching from the second coolant to the first coolant).

According to an embodiment of the method, it is furthermore preferred to introduce a gaseous medium into the interior of the freezing head via a separate sixth connection such that the second coolant particularly is pressed out of the interior of the freezing head by means of the gaseous medium, e.g. when switching from the second coolant (e.g. brine) to the first coolant (e.g. liquid nitrogen).

BRIEF DESCRIPTION OF DRAWINGS

Other characteristic features and embodiments of the present invention are described in greater detail below with reference to the figures. In these figures.

Figure 1:
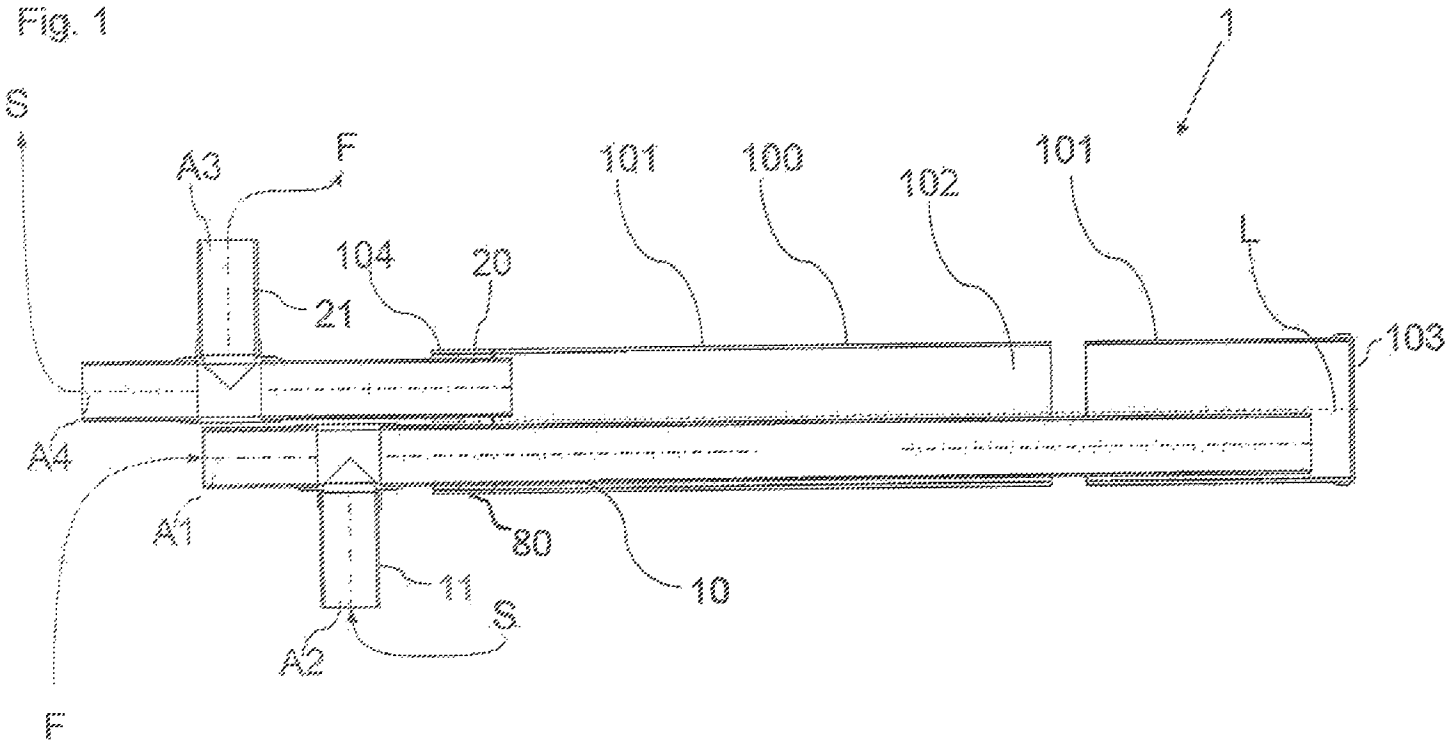
FIG. 1 shows a sectional view of an inventive apparatus with four connections.

An inventive ground freezing apparatus 1 of the type illustrated in FIGS. 1-11 basically comprises a freezing head 100, which extends along a longitudinal axis L and is configured for being arranged in a recess in the ground such that the cooling energy of the respective coolant can be transferred into the surrounding ground via the freezing head 100.

In this case, the freezing head 100 has a shell 101 that particularly is realized cylindrically and extends along said longitudinal axis or cylinder axis L, wherein said shell encloses an interior 102 of the freezing head 100, which serves for accommodating the respective coolants F and S. The freezing head 100 or the interior 102 may furthermore be closed toward the bottom by a base 103 connected to the shell 101 and toward the top by a cover 104 connected to the shell 101.

The inventive apparatus 1 according to FIGS. 1-11 furthermore comprises a first conduit 10 that serves for introducing a first cooling medium F (particularly liquid nitrogen) or a second, different cooling medium S (e.g. brine) into an interior 102 of the freezing head 100, wherein the first conduit 100 opens into the interior 102, as well as a second conduit 20 that serves for introducing the second cooling medium S into the interior 102 of the freezing head 100 or for withdrawing the first and/or the second cooling medium F, S from the interior 102 of the freezing head 100, wherein the second conduit 20 likewise opens into the interior 102 of the freezing head 100. The first and/or the second conduit 10, 20 particularly extend into the interior 102 of the freezing head 100 through said cover 104.

In FIGS. 1-11, the two conduits 10, 20 preferably are realized in the form of standpipes extending along the longitudinal axis L of the apparatus 1 or the freezing head 100, wherein the longitudinal axis extends, e.g., along the vertical line when the freezing head 100 is in its intended or operational position. As initially mentioned, the freezing head 100 may also be operated in different spatial positions. The axial direction of the freezing head 100 or the conduits 10, 20 therefore refers to the direction along the longitudinal axis whereas the radial direction of the conduits 10, 20 or the freezing head 100 refers to a direction extending perpendicular to the longitudinal axis L or the axial direction, respectively.

As shown in FIG. 1, the first and/or the second conduits can be arranged in the interior 102 of the freezing head 100 so as to be axially displaceable along the longitudinal axis L by means of a gland packing 80.

Figure 2:
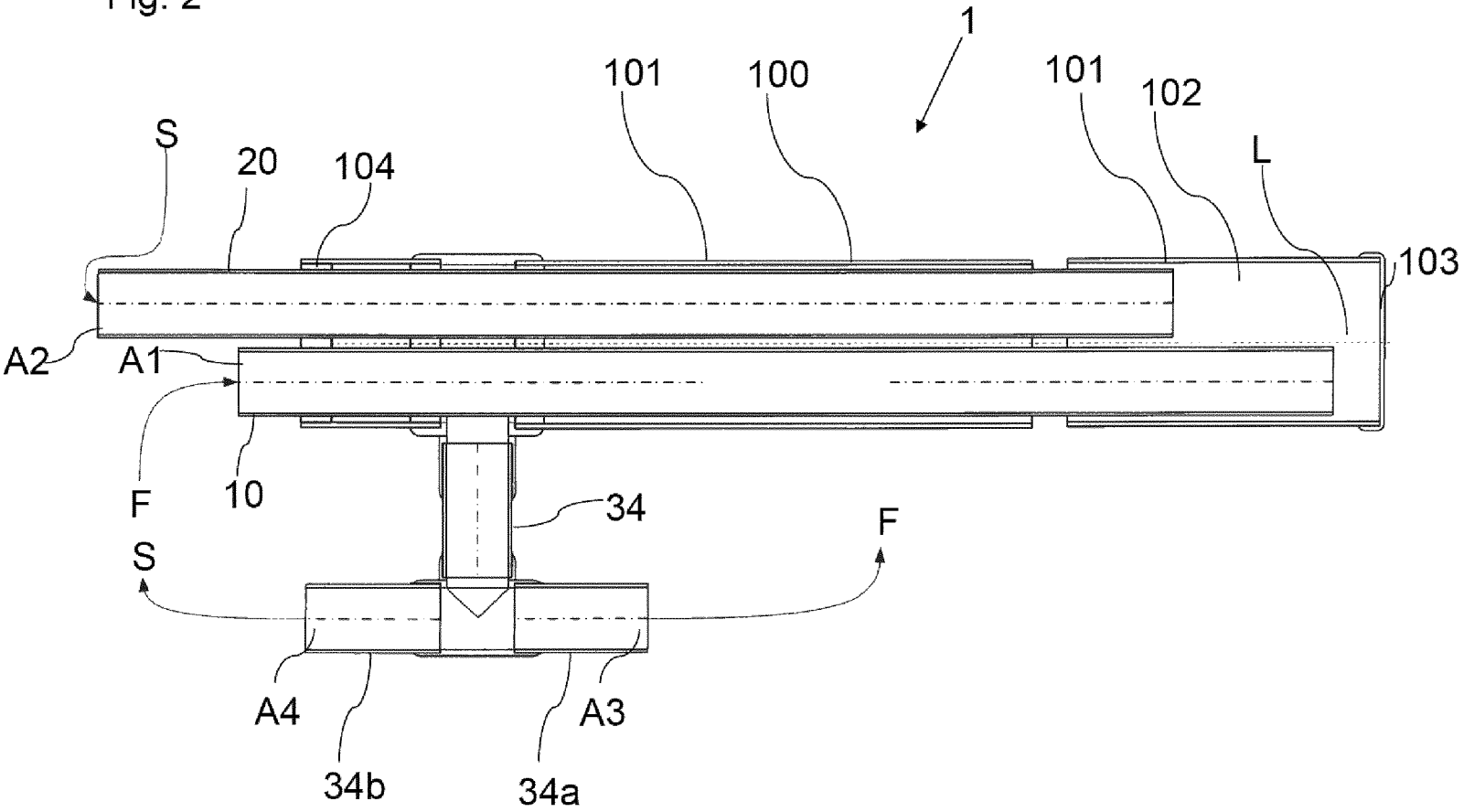
FIG. 2 shows a sectional view of another inventive apparatus with four connections.

Furthermore, the inventive apparatus 1 generally has at least three separate connections A1, A2, A3, namely a first connection A1, via which the first cooling medium F can be introduced into the interior 102 of the freezing head 100, a second connection A2, via which the second cooling medium S can be introduced into the interior 102 of the freezing head 100, and a third connection A3, via which the first or the second coolant F, S can be withdrawn from the interior 102 of the freezing head 100 (in this respect, one of the connections A3 or A4 can be eliminated, e.g. in FIGS. 1 and 2, such that only one connection is respectively available for withdrawing (returning) the coolants F, S and a corresponding conduit leading to the connection has to be changed over when the coolant is switched).

Four connections A1, A2, A3, A4 preferably are provided in the embodiment according to FIG. 1, wherein the first connection A1 is formed on the face of the first conduit 10 such that the first cooling medium F can be introduced into the first conduit 10 via the first connection A1 in the axial direction L and from the first conduit into the interior 102 of the freezing head 100.

Furthermore, the second connection A2 is formed laterally on the first conduit 10 outside the freezing head 100, wherein the second coolant S can be introduced into the first conduit 10 via the second connection A2 in the radial direction and from the first conduit into the interior 102 of the freezing head 100. In this case, the second connection A2 may be provided on the face of a connecting piece 11, which respectively extends from the first conduit 10 in the radial direction or perpendicular to the first conduit 10 outside the freezing head 100.

The third connection A3 is formed laterally on the second conduit 20, namely also outside the freezing head 100, wherein the first coolant F can be respectively withdrawn from the second conduit 20 and the interior 102 of the freezing head 100 (particularly in the form of a gaseous phase) via the third connection A3. In this case, the third connection A3 may be provided on the face of a connecting piece 21, which respectively extends from the second conduit 20 radially or perpendicularly outside the freezing head 100.

Furthermore, the fourth connection A4 is provided on the face of the second conduit 20 such that the second coolant S can be withdrawn from the interior 102 of the freezing head 20 via the fourth connection A4 in the axial direction.

In contrast, the third and the fourth connection A3, A4 are in the embodiment according to FIG. 2 respectively provided on the shell 101 of the freezing head 100, wherein the third and the fourth connection A3, A4 particularly are formed on or can be fluidically connected to a common connecting piece 34, which extends from the shell 101 of the freezing head 100 in the radial direction, and wherein both coolants F, S can be withdrawn from the interior 102 of the freezing head 100 via said connecting piece 34 in the radial direction of the freezing head 100. In this case, the third connection A3 and the fourth connection A4 may be respectively formed on a connecting piece 34*a* and 34*b*, which respectively extend perpendicular to and originate from the common connecting piece 34. In this case, the two connecting pieces 34*a*, 34*b* may be aligned with one another and furthermore be oriented parallel to the longitudinal axis L of the shell 101.

Furthermore, the first connection A1 is provided on the face of the first conduit 10 and serves for introducing the first coolant F into the interior 102 of the freezing head 100 in the axial direction L. In this case, the second connection A2 is provided on the face of the second conduit such that the second coolant S can be respectively introduced into the second conduit 20 and the interior 102 of the freezing head 101 via the second connection A2 in the axial direction L.

Figure 3:
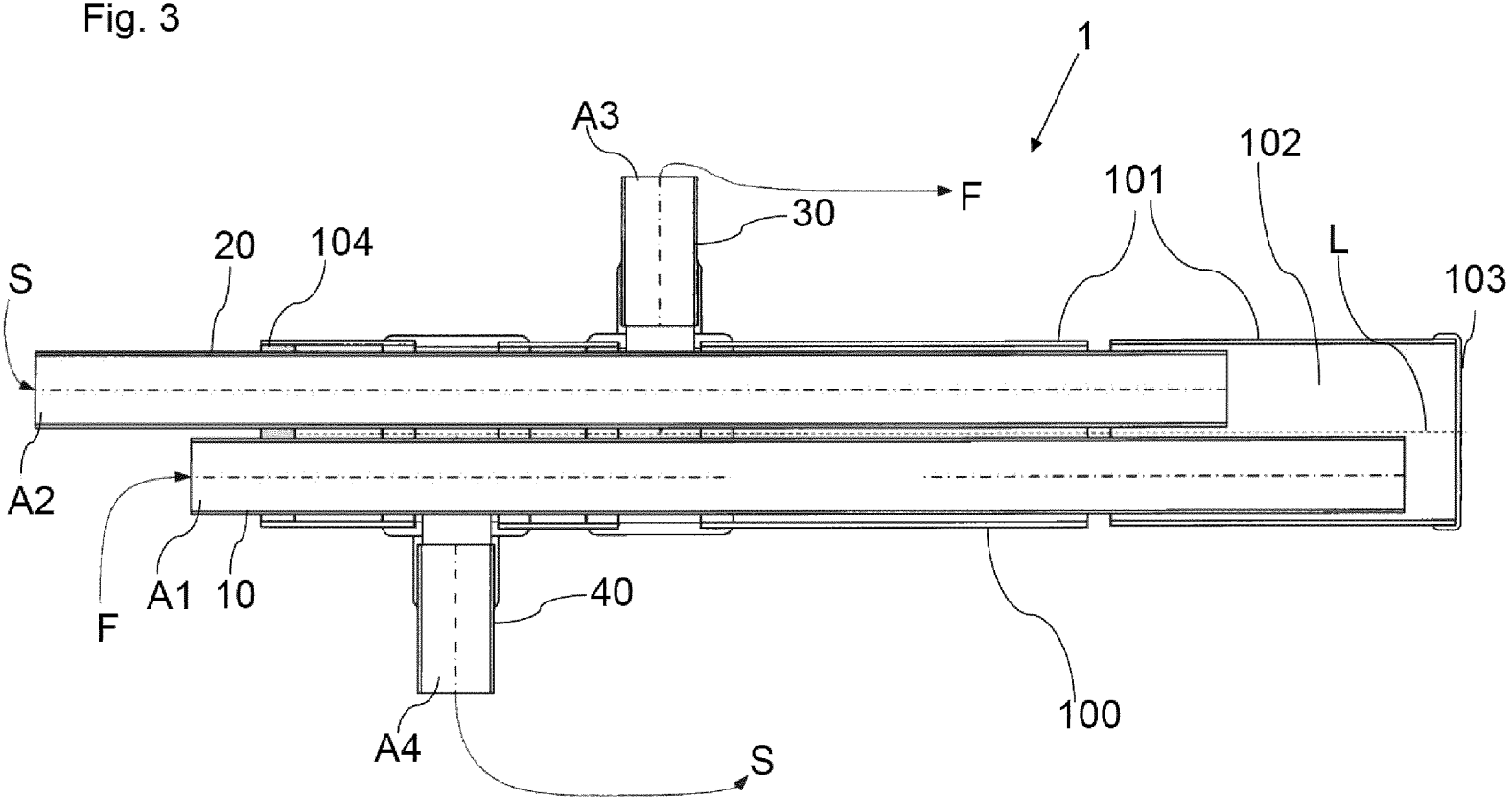
FIG. 3 shows a sectional view of another inventive apparatus with four connections.

FIG. 3 shows a modification of the embodiment of an inventive apparatus 1 illustrated in FIG. 2, wherein the first and the second connection A1, A2 are in this case configured as in the embodiment illustrated in FIG. 2.

In contrast to FIG. 2, the third and the fourth connection A3, A4 are now respectively provided separately on the shell 101 of the freezing head 100, wherein the third and the fourth connection A3, A4 are respectively formed on the face of an associated connecting piece 30, 40, and wherein said connecting pieces 30, 40 respectively extend from the shell 101 in a radial direction, preferably in opposite directions. In this case, the third and the fourth connection and the respectively associated connecting piece 30, 40 are provided on opposite sides of the shell 101. The respective coolant F, S can therefore be respectively withdrawn from the interior 102 of the freezing head 100 via the respective connecting piece 30, 40 in the radial direction of the freezing head 100.

Figure 4:
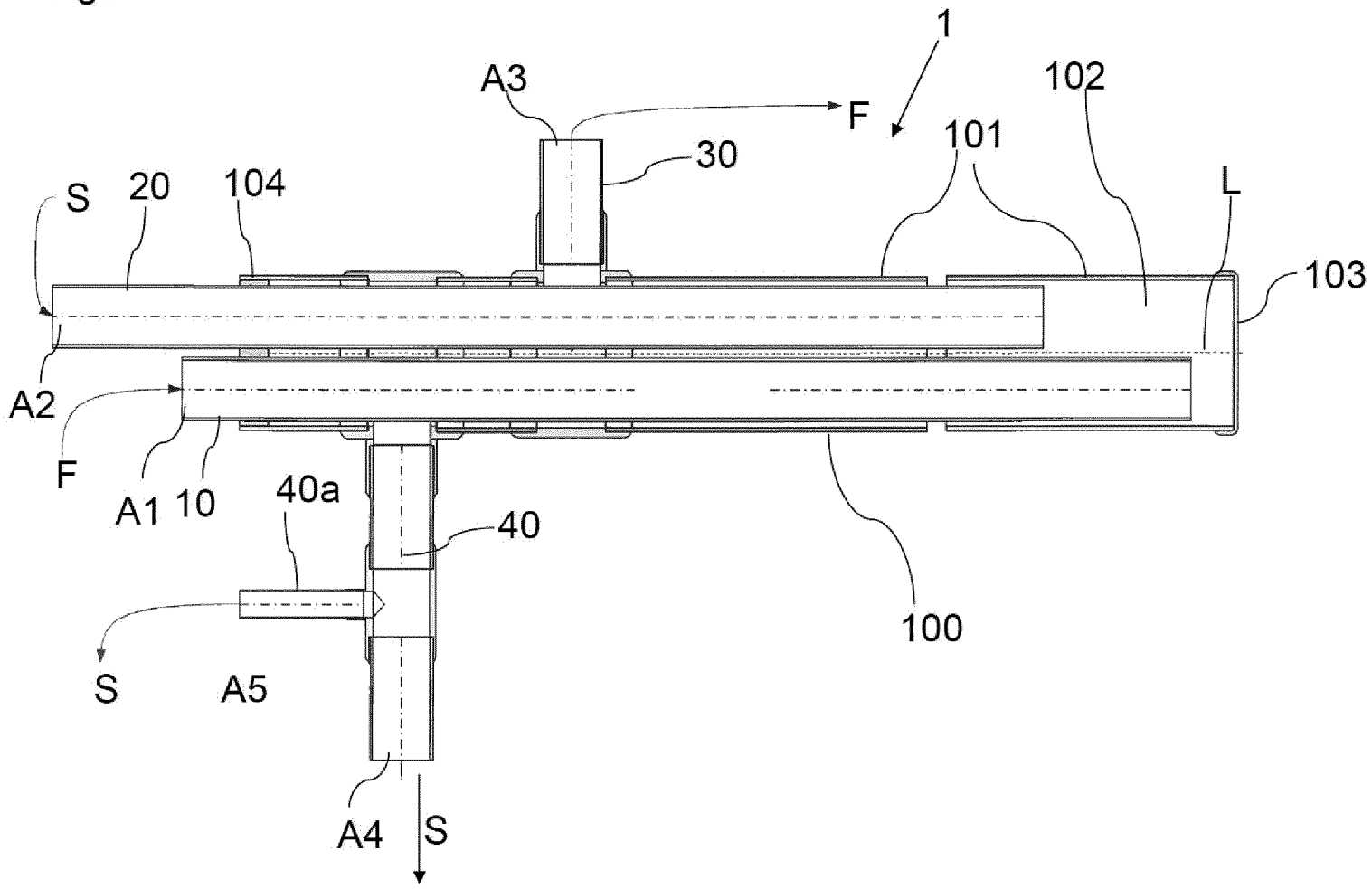
FIG. 4 shows a sectional view of an inventive apparatus with five connections.

FIG. 4 furthermore shows an embodiment of the inventive apparatus 1 that represents a modification of the apparatus 1 illustrated in FIG. 3 and—in contrast to FIG. 3—has five connections A1, A2, A3, A4, A5 (the connections A1, A2, A3, A4 are configured as in FIG. 3), wherein the interior 102 of the freezing head 100 can be ventilated via the fifth connection A5, e.g. prior to a switch from the first coolant (e.g. liquid gas) to the second coolant (e.g. brine), and/or the second coolant S can be pressed out of the interior 102 of the freezing head 100 via said fifth connection, e.g. when switching from the second coolant S (e.g. brine) to the first coolant F (e.g. liquid gas).

According to FIG. 4, it is proposed that the fifth connection A5 is formed laterally on said connecting piece 40, on the face of which the fourth connection A4 is formed as in FIG. 3. In this case, the fifth connection A5 preferably is arranged on the face of a connecting piece 40*a*, which particularly originates from the connecting piece 40 perpendicularly and extends parallel to the axial direction L.

Figure 5:
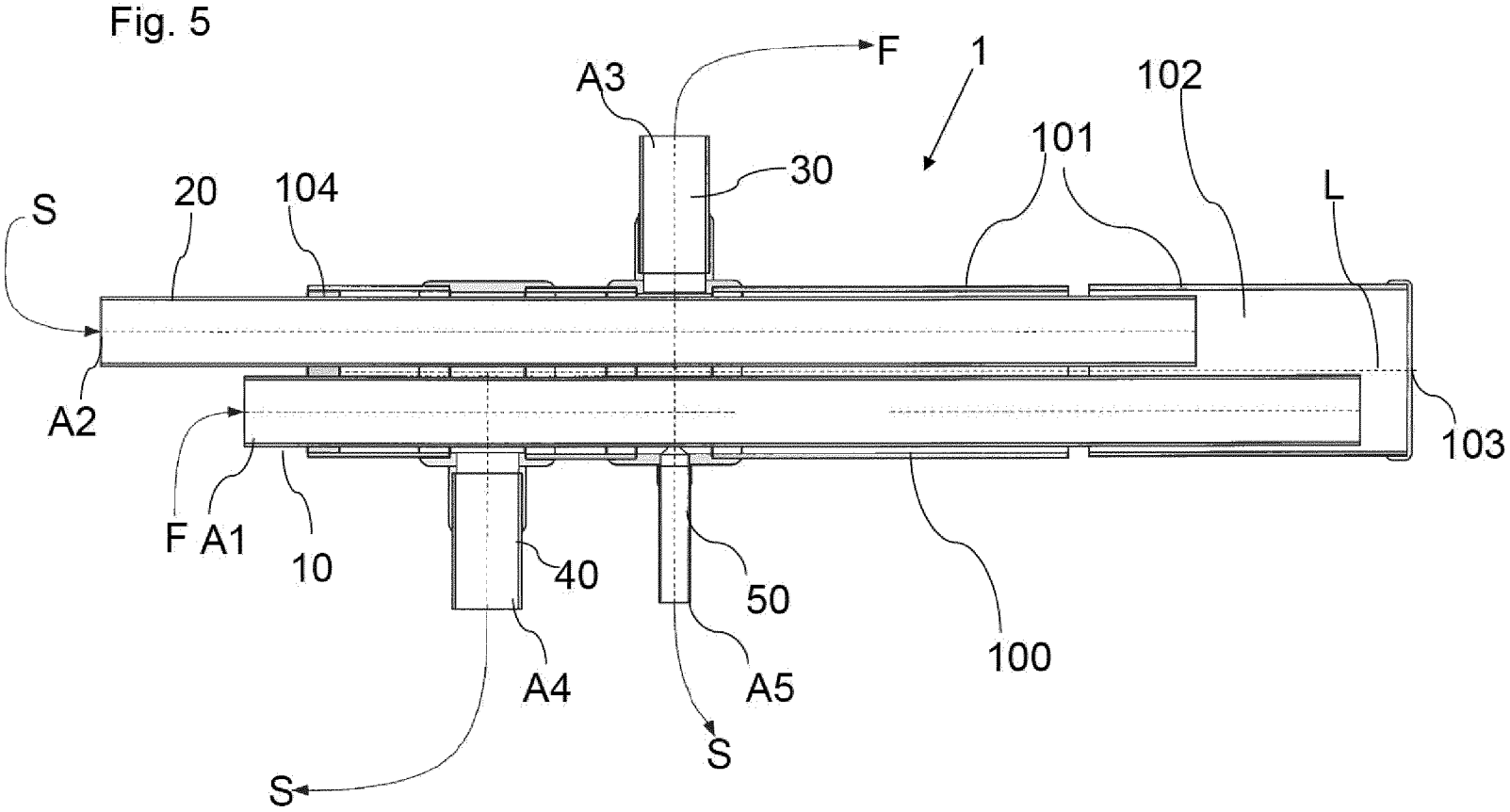
FIG. 5 shows a sectional view of another inventive apparatus with five connections.

FIG. 5 furthermore shows a modification of the apparatus 1 illustrated in FIG. 4, wherein the fifth connection A5 is in contrast to FIG. 4 provided separately on the shell 101 of the freezing head 100, and wherein the fifth connection A5 is formed on the face of a connecting piece that originates from the shell 101 and preferably extends in the radial direction of the shell 101.

Figure 6:
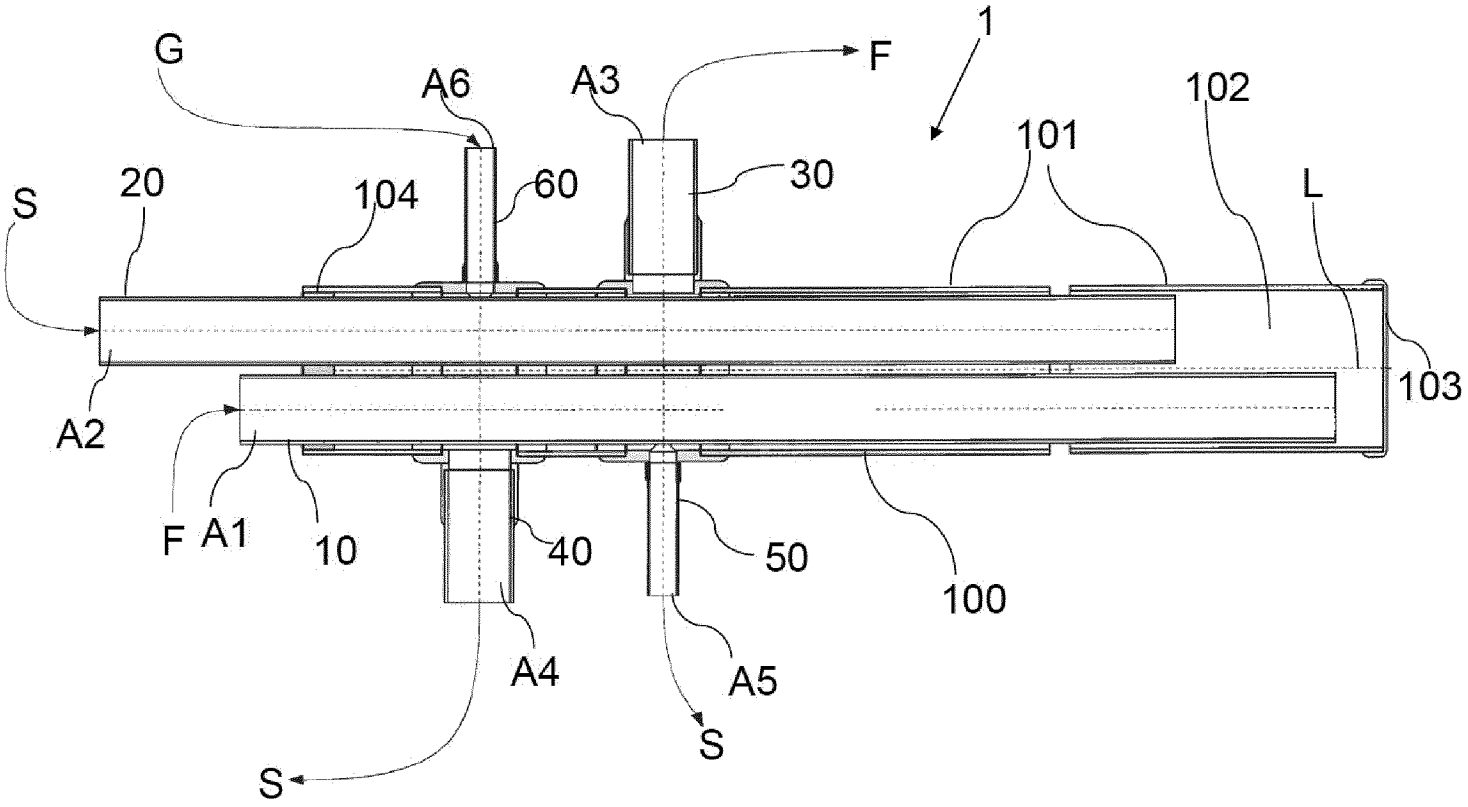
FIG. 6 shows a sectional view of an inventive apparatus with six connections.

FIG. 6 furthermore shows an embodiment of an inventive apparatus 1 that represents a modification of the apparatus 1 illustrated in FIG. 5. In this case, the apparatus 1 has an additional sixth connection A6, via which a gaseous medium G can be introduced into the interior 102 of the freezing head 100 such that the second coolant S particularly can be pressed out of the interior 102 of the freezing head 100 by means of the gaseous medium G, e.g. when switching from the second coolant S (e.g. brine) to the first coolant F (e.g. liquid nitrogen).

In the apparatus illustrated in FIG. 6, the connections A1, A2, A3, A4, A5 are configured as described above with reference to FIG. 5. According to FIG. 6, said sixth connection A6 is now provided separately on the shell 101 of the freezing head 100, wherein the sixth connection A6 preferably is formed on the face of an associated separate connecting piece 60 that extends from the shell 101 in the radial direction.

Figure 7:
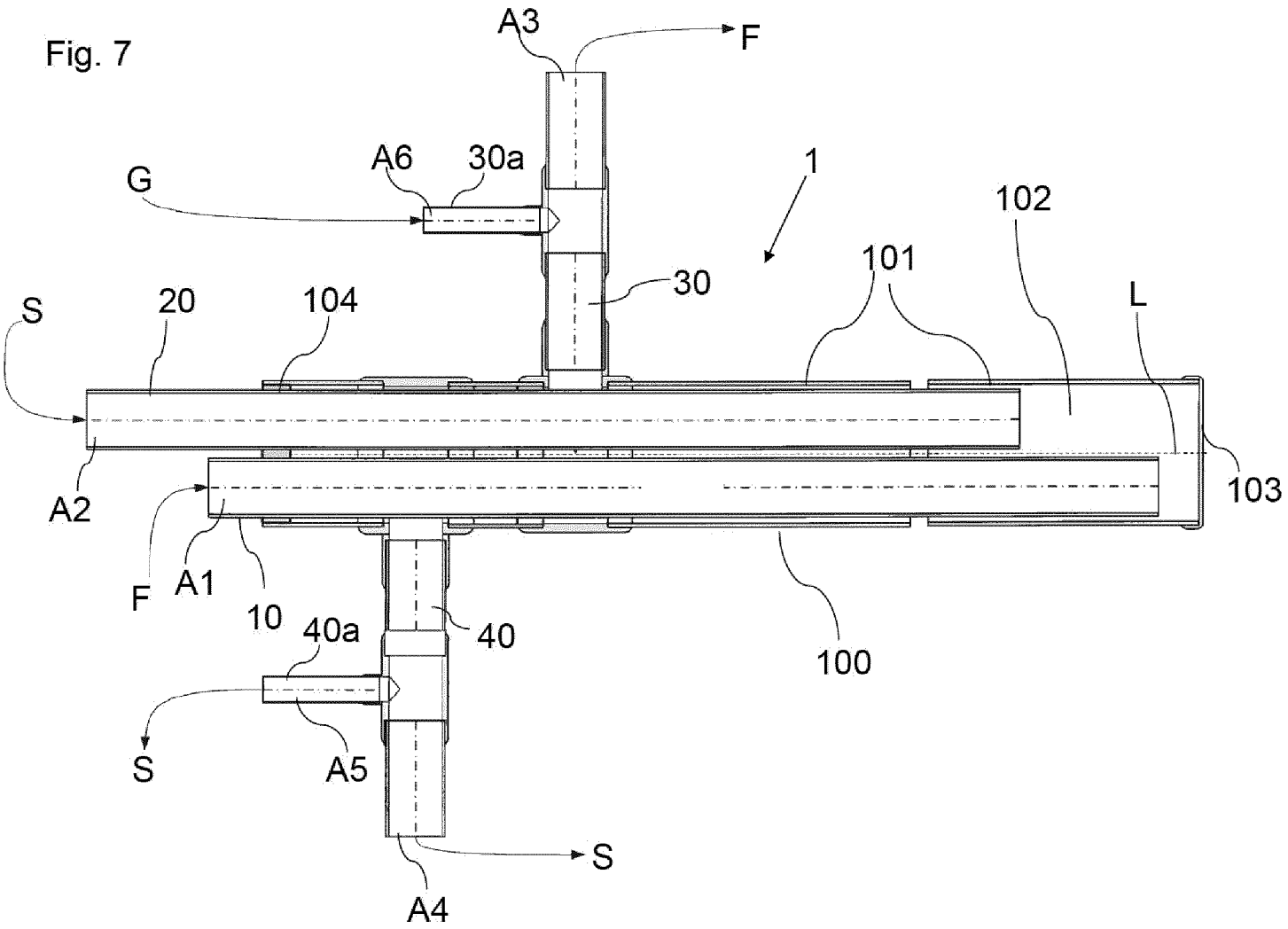
FIG. 7 shows a sectional view of another inventive apparatus with six connections.

According to FIG. 7, which shows a modification of the apparatus 1 illustrated in FIG. 4, the sixth connection A6 may alternatively also be formed laterally on said connecting piece 30, on the face of which the third connection A3 is also formed. The sixth connection A6 according to FIG. 7 may be provided on the face of a connecting piece 30*a* that perpendicularly opens into said connecting piece 30. The connecting piece 30*a* may extend parallel to the axial direction L in this case.

FIGS. 8-11 show top views of the freezing head 100, particularly of the cover 104, in the axial direction L in order to elucidate potential orientations of the above-described connecting pieces.

Figure 8:
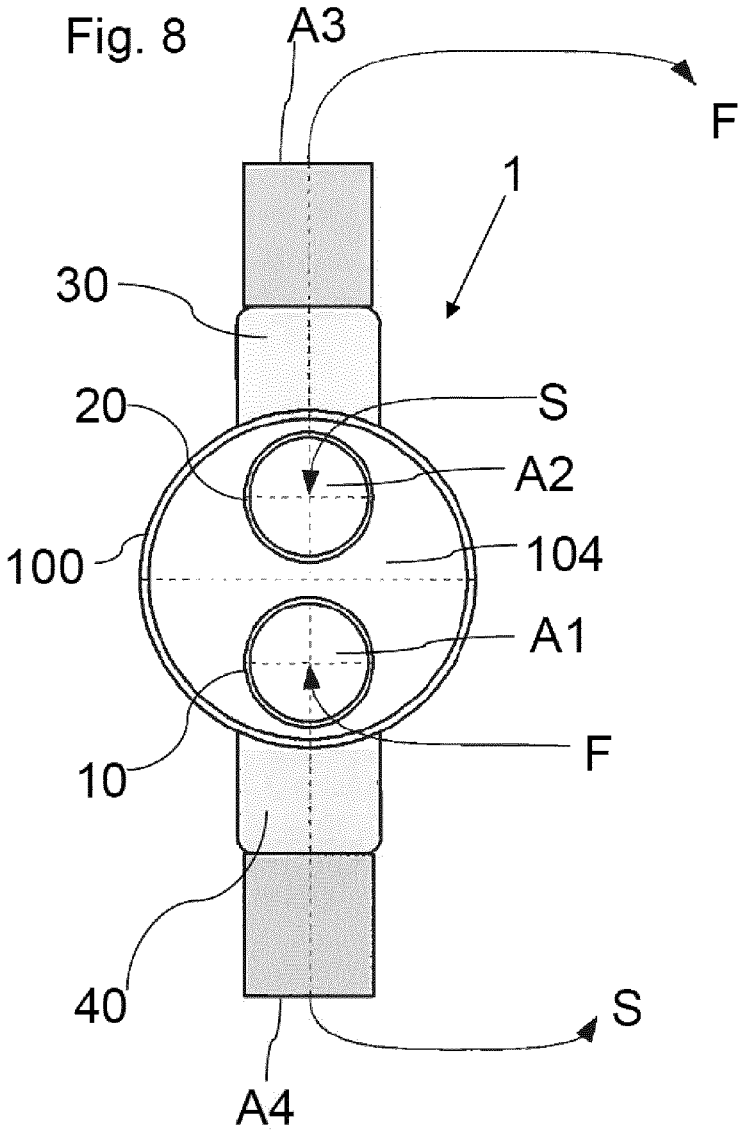
FIG. 8 shows a top view of an inventive apparatus in the axial direction (e.g. corresponding to FIG. 3)

FIG. 8 shows a top view of an inventive apparatus 1 in the axial direction L as in FIG. 3, wherein the two connecting pieces 30, 40 and the connections A3, A4 provided on the faces thereof, which respectively serve for withdrawing the first coolant F (e.g. nitrogen waste gas) and the heated second coolant S (e.g. brine), respectively extend from the shell 101 in opposite directions. In this case, the two connecting pieces 30, 40 may be arranged in different planes, wherein said planes extend perpendicular to the longitudinal axis or the axial direction L, respectively.

Figure 9:
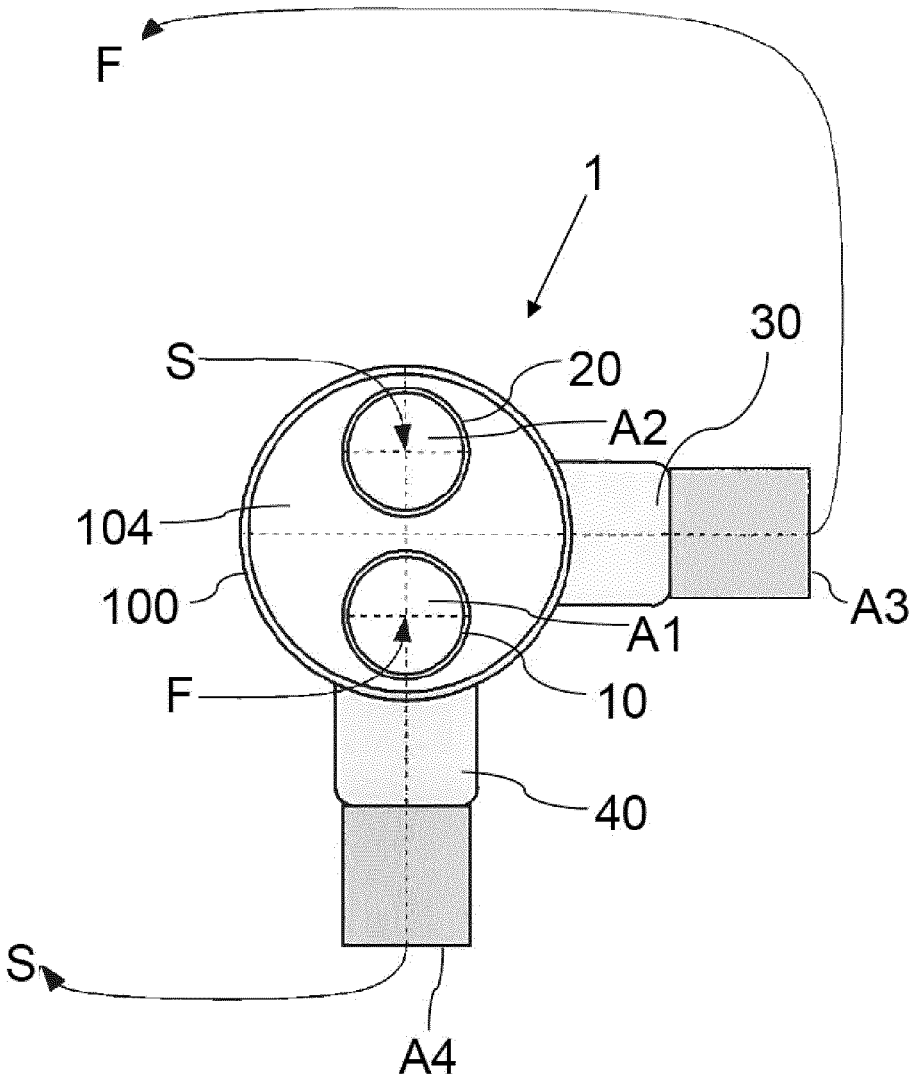
FIG. 9 shows a top view of a modification of the apparatus according to FIG. 8 in the axial direction.

FIG. 9 shows an alternative orientation of the two connecting pieces 30, 40 relative to one another, wherein the two connecting pieces 30, 40 respectively extend from the shell radially, but in contrast to FIG. 8 at an angle of 90° to one another.

Figure 10:
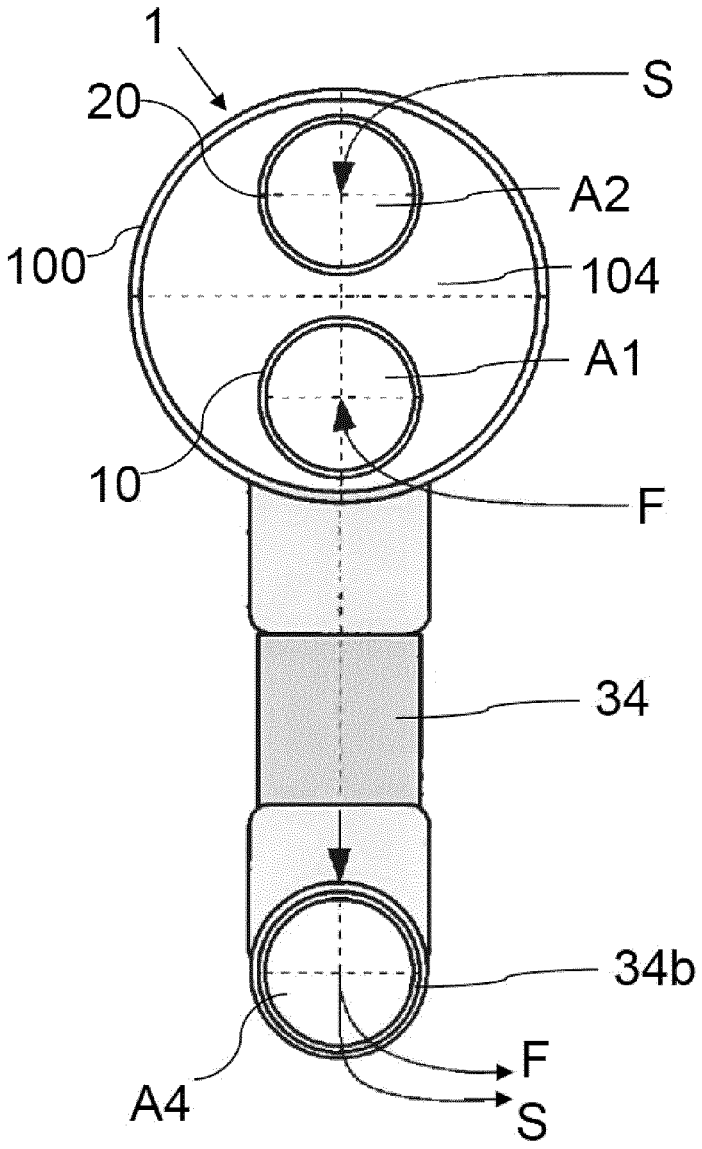
FIG. 10 shows a top view of an inventive apparatus in the axial direction (e.g. corresponding to FIG. 2)

FIG. 10 furthermore shows a top view of an inventive apparatus 1 corresponding to FIG. 2 in the axial direction L, wherein the connecting piece 34 in this case extends from the shell 101 in the radial direction and the two connecting pieces 34*a* and 34*b*, which originate from the connecting piece 34 and on the faces of which the third connection A3 and the fourth connection A4 are respectively formed, once again are aligned with one another, extend in the axial direction L and originate from the common connecting piece 34 in opposite directions.

Figure 11:
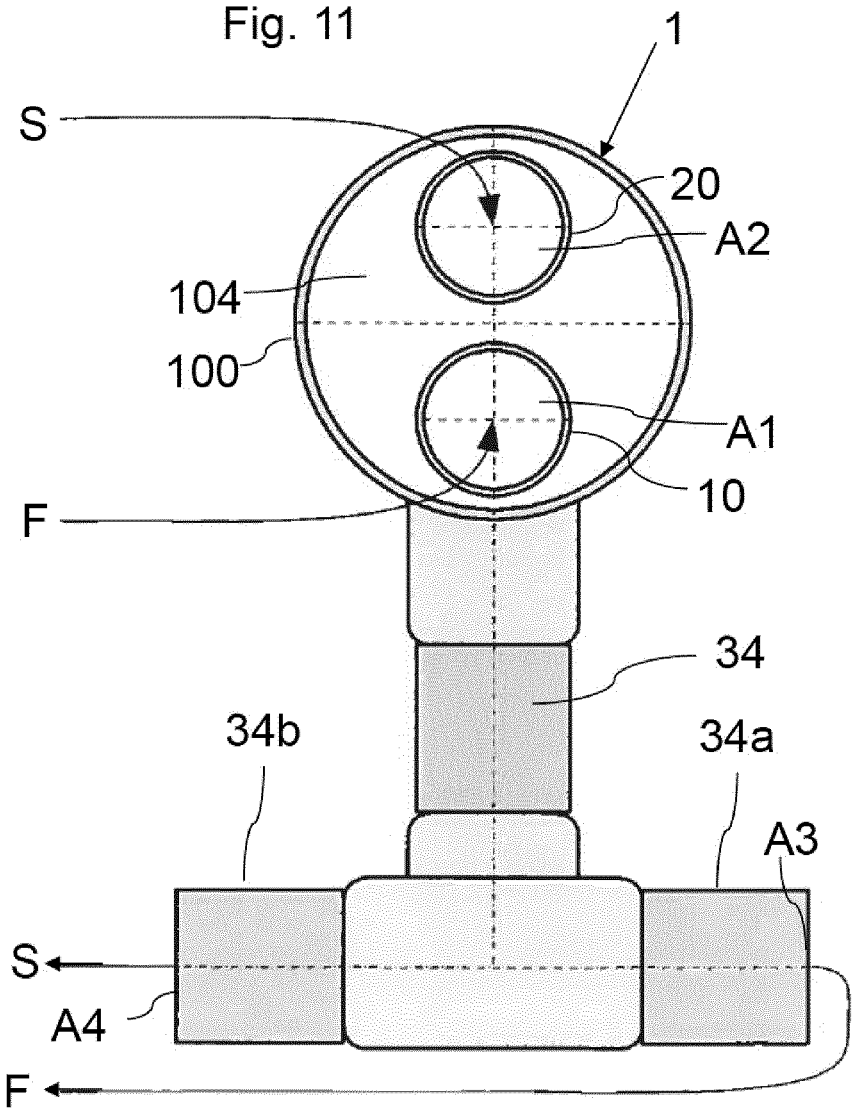
FIG. 11 shows a top view of a modification of the apparatus according to FIG. 10 in the axial direction.

FIG. 11 shows a corresponding modification, in which the two connecting pieces 34*a* and 34*b* extend in contrast to FIG. 10 perpendicular to the axial direction L.

LIST OF REFERENCE SYMBOLS

| | |
|---|---|
| 1 | Apparatus |
| 10 | First conduit |
| 20 | Second conduit |
| 11, 21, 30, 30a, 34a, 34b, 40, 40a, 50, 60 | Connecting piece |
| 100 | Freezing head |
| 101 | Shell |
| 102 | Interior |
| 103 | Base |
| 104 | Cover |
| A1, A2, A3, A4, A5, A6 | Connection |
| F | First coolant |
| S | Second coolant |
| G | Gaseous medium |
| L | Longitudinal axis |

The invention claimed is:

1. A ground freezing apparatus (1) comprising:

a freezing head (100) extending along a longitudinal axis (L), a first conduit (10) for introducing cooling medium into an interior (102) of the freezing head (100), wherein the first conduit (10) opens into the interior (102), and a second conduit (20) for introducing cooling medium into the interior (102) of the freezing head (100) or for withdrawing cooling medium (F, S) from the interior (102) of the freezing head (100), wherein the second conduit (20) opens into the interior (102) of the freezing head (100), wherein the apparatus (1) has at least three separate connections (A1, A2, A3), a first connection (A1) for introducing a first cooling medium (F) into the interior (102) of the freezing head (100) via the first conduit (10), a second connection (A2) for introducing a second cooling medium (S) into the interior (102) of the freezing head (100) wherein said second connection (A2) is in fluid communication with either the first conduit (10) or the second conduit (20), and a third connection (A3) for withdrawing the first cooling medium or the second cooling medium (F, S) from the interior (102) of the freezing head (100).

2. The apparatus according to claim 1, wherein the first connection (A1) is formed on the first conduit (10) such that the first cooling medium (F) can be introduced into the first conduit (10), as well as into the interior (102) of the freezing head (100), in the axial direction of the first conduit (10).

3. The apparatus according to claim 1, wherein the second connection (A2) is formed on the first conduit (10) outside the freezing head (100), wherein the second cooling medium (S) can be introduced into the first conduit (10) via the second connection (A2) and from the first conduit into the interior (102) of the freezing head (100).

4. The apparatus according to claim 1, wherein the apparatus has a fourth connection (A4), wherein the second cooling medium (S) can be withdrawn from the interior (102) of the freezing head (100) via the fourth connection (A4), and wherein the first cooling medium (F) can be withdrawn from the interior (102) of the freezing head (100) via the third connection (A3).

5. The apparatus according to claim 4, wherein the fourth connection (A4) is formed on the face of the second conduit (20) such that the second cooling medium (S) can be withdrawn from the second conduit (20) in the axial direction thereof, wherein the third connection (A3) is formed laterally on the second conduit (20) such that the first cooling medium (F) can be withdrawn from the second conduit (20) in the radial direction of the second conduit (20), and wherein the second connection (A2) is formed laterally on the first conduit (10) such that the second cooling medium (S) can be introduced into the first conduit (10), as well as into the interior (102) of the freezing head (100), in the radial direction of the first conduit (10).

6. The apparatus according to claim 4, wherein the third connection and the fourth connection (A3, A4) are respectively provided on a shell (101) of the freezing head (100).

7. The apparatus according to claim 6, wherein the third connection and the fourth connection (A3, A4) are formed on a common connecting piece (34) that originates from the shell (101) of the freezing head (100).

8. The apparatus according to claim 4, wherein the third connection and the fourth connection (A3, A4) are respectively provided separately on a shell (101) of the freezing head (100), wherein the third connection and the fourth connection (A3, A4) are respectively formed on an associated connecting piece (30, 40), and wherein said connecting pieces (30, 40) originate from the shell (101).

9. The apparatus according to claim 4, wherein the apparatus has a fifth connection (A5), wherein the interior (102) of the freezing head (100) can be ventilated via the fifth connection.

10. The apparatus according to claim 9, wherein the fifth connection (A5) is formed laterally on a connecting piece (40), on which the fourth connection (A4) is also formed.

11. The apparatus according to claim 9, wherein the fifth connection is provided separately on a shell (101) of the freezing head (100), wherein the fifth connection (A5) is formed on a connecting piece (50) that originates from the shell (101).

12. The apparatus according to claim 9, wherein the apparatus (1) has a sixth connection (A6), wherein a gaseous medium (G) can be introduced into the interior (102) of the freezing head (100) via the sixth connection.

13. The apparatus according to claim 12, wherein the sixth connection (A6) is provided separately on the shell (101) of the freezing head (100), wherein the sixth connection (A6) is formed on an associated connecting piece (60) that originates from the shell (101).

14. The apparatus according to claim 12, wherein the sixth connection (A6) is formed laterally on a connecting piece (30) which originates from a shell (101) of the freezing head (100), and the third connection (A3) is also formed on the connecting piece (30).

15. The apparatus according to claim 4, wherein the apparatus has a fifth connection (A5), wherein the second cooling medium (S) can be pressed out of the interior (102) of the freezing head (100) via the fifth connection.

16. The apparatus according to claim 1, wherein the first conduit, the second conduit, or both the first conduit and the second conduit (10, 20) enter the freezing head (100) in the axial direction.

17. The apparatus according to claim 1, wherein the first conduit, the second conduit, or both the first conduit and the second conduit (10, 20) are arranged in the interior (102) of the freezing head (100) so as to be axially displaceable along the longitudinal axis (L) by means of a gland packing (80).

18. The apparatus according to claim 1, wherein the third connection (A3) is formed on the second conduit (20) outside the freezing head (100), wherein the first cooling medium (F) or the second cooling medium (S) can be withdrawn from the second conduit (20), as well as from the interior (102) of the freezing head (100), via the third connection (A3).

* * * * *